US010527009B2

(12) United States Patent
Nagata

(10) Patent No.: US 10,527,009 B2
(45) Date of Patent: Jan. 7, 2020

(54) EXHAUST GAS RECIRCULATING APPARATUS

(71) Applicant: TOYOTA JIDOSHA KABUSHIKI KAISHA, Aichi-ken (JP)

(72) Inventor: Ryosuke Nagata, Toyota (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 44 days.

(21) Appl. No.: 15/927,333

(22) Filed: Mar. 21, 2018

(65) Prior Publication Data

US 2018/0283325 A1 Oct. 4, 2018

(30) Foreign Application Priority Data

Mar. 28, 2017 (JP) ..... 2017-062522

(51) Int. Cl.

| | |
|---|---|
| ***F02B 47/08*** | (2006.01) |
| ***F02M 26/19*** | (2016.01) |
| ***F02M 26/41*** | (2016.01) |
| ***F02M 35/112*** | (2006.01) |
| ***F02M 35/10*** | (2006.01) |

(52) U.S. Cl.

CPC ..... *F02M 26/19* (2016.02); *F02M 26/41* (2016.02); *F02M 35/10222* (2013.01); *F02M 35/112* (2013.01)

(58) Field of Classification Search

CPC ..... F02M 26/00; F02M 26/05; F02M 26/07; F02M 26/19; F02M 26/21; F02M 35/10222

USPC ..... 123/568.11, 568.17, 568.18, 184.21, 123/184.54

See application file for complete search history.

(56) References Cited

U.S. PATENT DOCUMENTS 4,257,372 A * 3/1981 Etoh ..... B01D 53/9495 123/198 F
4,318,386 A * 3/1982 Showalter ..... F02M 29/06 123/188.14
4,741,295 A * 5/1988 Hosoya ..... F02M 35/10032 123/184.31

(Continued)

FOREIGN PATENT DOCUMENTS

JP 2000-192859 A 7/2000
JP 2005-113847 A 4/2005

(Continued)

*Primary Examiner* — John Kwon
(74) *Attorney, Agent, or Firm* — Hauptman Ham, LLP

(57) ABSTRACT

An exhaust gas recirculating apparatus is arranged in an intake manifold. The intake passages are aligned in a first direction. The apparatus has an inter-cylinder exhaust gas distributing portion, a first introduction passage, and a second introduction passage. The direction in which the intake passages are aligned is referred to as a second direction. The first introduction passage is arranged at such a position that the center line of the first introduction passage in the second direction is offset from the center line of the first intake passage in the second direction to be away from the second intake passage. The second introduction passage is arranged at such a position that the center line of the second introduction passage in the second direction is offset from the center line of the second intake passage in the second direction to be away from the first intake passage.

4 Claims, 4 Drawing Sheets

(56) References Cited

U.S. PATENT DOCUMENTS

| | | | | |
|---|---|---|---|---|
| 6,138,651 | A * | 10/2000 | Mori | F02M 26/19 123/568.17 |
| 2005/0076874 | A1 | 4/2005 | Nakamura | |
| 2012/0291760 | A1 * | 11/2012 | Vigild | F02M 31/13 123/542 |

FOREIGN PATENT DOCUMENTS

| | | | |
|---|---|---|---|
| JP | 2005-226585 | A | 8/2005 |
| JP | 2015-145655 | A | 8/2015 |
| WO | 2014/140153 | A1 | 9/2014 |

* cited by examiner

EXHAUST GAS RECIRCULATING APPARATUS

RELATED APPLICATIONS

The present application claims priority of Japanese Application Number 2017-062522, filed on Mar. 28, 2017, the disclosure of which is hereby incorporated by reference herein in its entirety.

BACKGROUND

The present disclosure relates to an exhaust gas recirculating apparatus for an internal combustion engine.

An internal combustion engine has an intake manifold that has intake passages. The intake passages are aligned in the direction in which cylinders are aligned and connected to the respective cylinders. The intake manifold may have an exhaust gas recirculating apparatus to introduce exhaust gas into the respective intake passages.

The exhaust gas recirculating apparatus described in Japanese Laid-Open Patent Publication No. 2005-226585 has an exhaust gas distributing portion and introduction passages. The exhaust gas distributing portion distributes exhaust gas to two adjacent intake passages. The introduction passages introduce the exhaust gas from the exhaust gas distributing portion to the corresponding intake passages. The two intake passages are located on the opposite sides of the exhaust gas distributing portion. The introduction passages are arranged on the side surfaces of the corresponding intake passages. In this configuration, the exhaust gas supplied to the exhaust gas distributing portion is introduced into the two intake passages via the corresponding introduction passages. Also known is an exhaust gas recirculating apparatus, as described in Japanese Laid-Open Patent Publication No. 2000-192859, in which an introduction passage is arranged in the middle of an intake passage.

In some cases, due to intake pulsations in the intake passages or delayed closure of the intake valves, the fresh air that has been drawn into a cylinder may blow back from the intake passage to one of the introduction passages, which communicates with the exhaust gas distributing portion. After blowing back from the intake passage, the fresh air flows into an adjacent intake passage via the other introduction passage, which communicates with the exhaust gas distributing portion. As a result, the fresh air decreases the introduction amount of exhaust gas in the adjacent intake passage. This varies the introduced amount of exhaust gas among the cylinders.

SUMMARY

Accordingly, it is an objective of the present disclosure to provide an exhaust gas recirculating apparatus capable of reducing variation in the amount of exhaust gas that is introduced into the respective cylinders.

To achieve the foregoing objective, an exhaust gas recirculating apparatus is provided that is arranged in an intake manifold that has a plurality of intake passages. The intake passages are aligned in a first direction, in which cylinders of an internal combustion engine are aligned, and connected to the cylinders. The exhaust gas recirculating apparatus includes an exhaust gas distributing portion that distributes exhaust gas supplied to the exhaust gas recirculating apparatus to a plurality of passages. The exhaust gas recirculating apparatus is configured to introduce the exhaust gas into the respective intake passages. The exhaust gas recirculating apparatus includes an inter-cylinder distributing portion, which is a most downstream section of the exhaust gas distributing portion and extends in a second direction, in which the intake passages are aligned, a first introduction passage, which allows communication between a first intake passage, which is one of adjacent two of the intake passages, and the inter-cylinder distributing portion, and a second introduction passage, which allows communication between a second intake passage, which is the other one of the adjacent two intake passages, and the inter-cylinder distributing portion, with which the first introduction passage communicates. The first introduction passage and the second introduction passage are each arranged such that a distance between a center line of the first introduction passage in the second direction and a center line of the second introduction passage in the second direction is greater than a distance between a center line of the first intake passage in the second direction and a center line of the second intake passage in the second direction.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An exhaust gas recirculating apparatus according to one embodiment will now be described with reference to FIGS. 1 to 4. The exhaust gas recirculating apparatus of the present embodiment is integrated with an intake manifold 10, which is made of plastic and joined to an inline-four-cylinder internal combustion engine.

Figure 1:
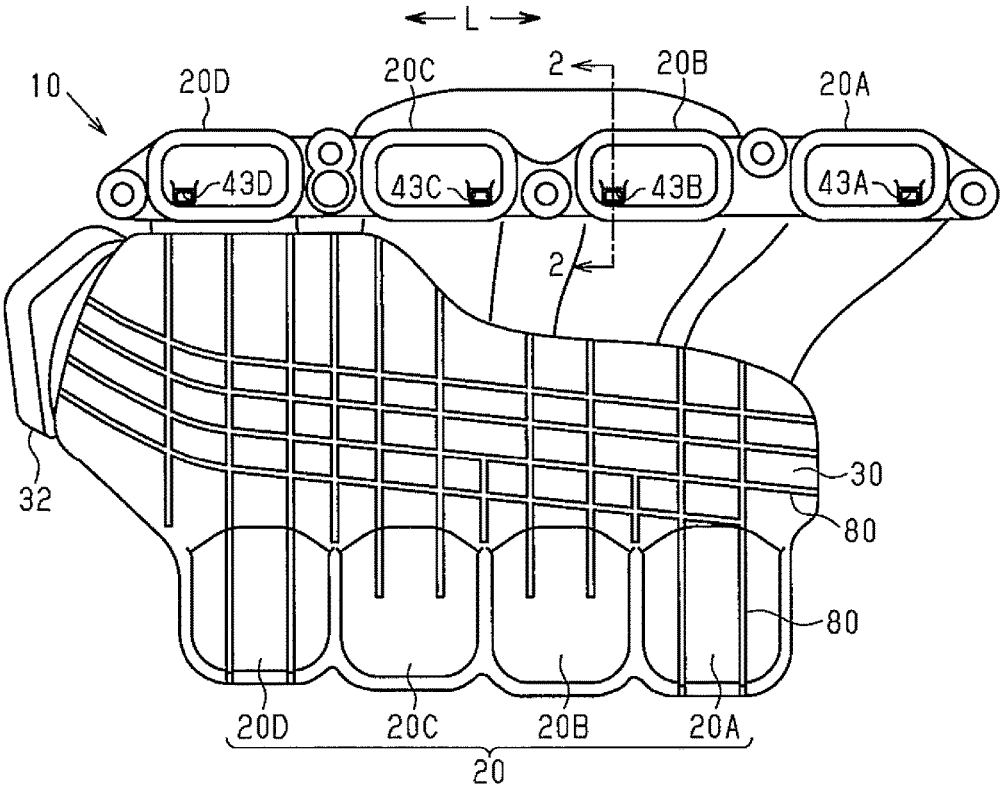
FIG. 1 is a front view showing an intake manifold that has an exhaust gas recirculating apparatus according to one embodiment of the present disclosure.

As shown in FIG. 1, an intake manifold 10 has a surge tank 30. The surge tank 30 extends in a first direction (as represented by arrow L in the drawings) in which cylinders of the engine, to which the intake manifold 10 is joined, are aligned. Ribs 80 are formed on the outer wall of the surge tank 30. A throttle flange 32 is arranged at one of ends in the longitudinal direction of the surge tank 30. A throttle body, which includes a throttle valve, is connected to the throttle flange 32.

Figure 2:
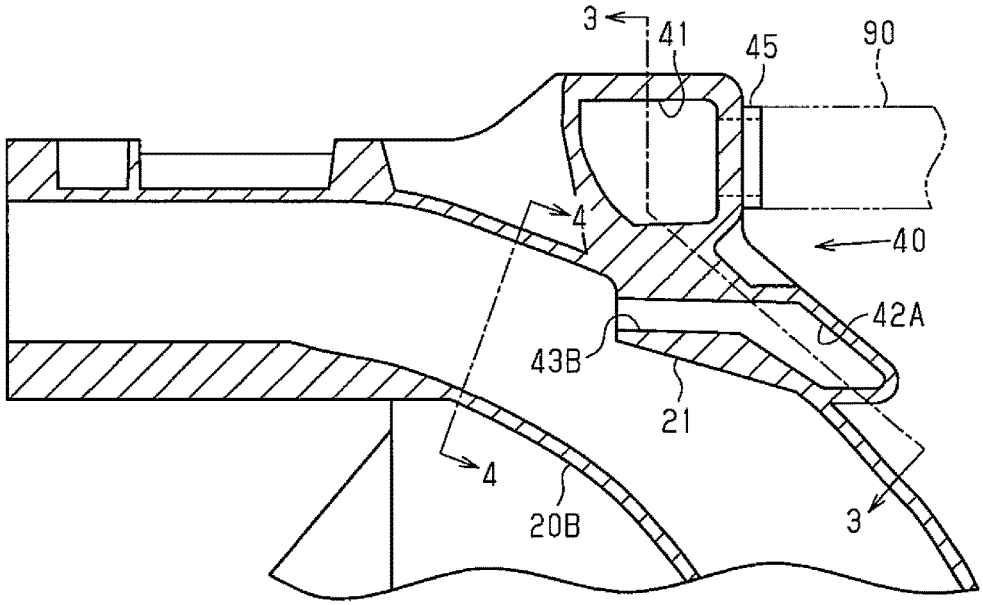
FIG. 2 is a cross-sectional view taken along line 2-2 of FIG. 1, showing the intake manifold.

With reference to FIGS. 1 and 2, the intake manifold 10 has four intake passages 20. The intake passages 20 are curved passages branched from the surge tank 30. The intake passages 20 are connected to the respective four cylinders of the engine. The intake passages 20 are aligned in the first direction, in which the cylinders are aligned. The four cylinders are referred to as a first cylinder, a second cylinder, a third cylinder, and a four cylinder arranged sequentially in the first direction. Hereinafter, the intake passage 20 connected to the first cylinder, the intake passage 20 connected to the second cylinder, the intake passage 20 connected to the third cylinder, and the intake passage 20 connected to the fourth cylinder will be referred to as a first intake passage 20A, a second intake passage 20B, a third intake passage 20C, and a fourth intake passage 20D, respectively.

As illustrated in FIG. 2, an exhaust gas recirculating apparatus 40 is arranged above the curved sections of the intake passages 20. The exhaust gas recirculating apparatus 40 is configured to introduce exhaust gas into the respective intake passages 20.

Figure 3:
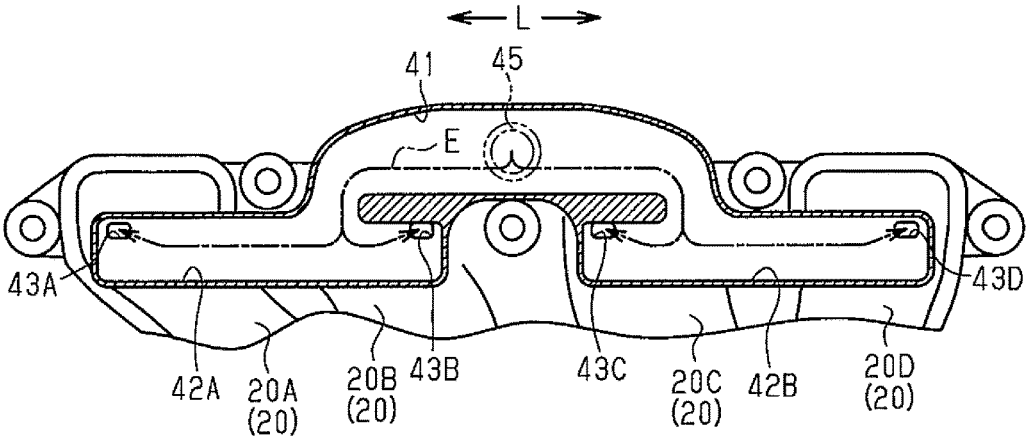
FIG. 3 is a cross-sectional view taken along line 3-3 of FIG. 2, showing the intake manifold.

Referring to FIGS. 2 and 3, the exhaust gas recirculating apparatus 40 includes a main distributing portion 41 to distribute exhaust gas downstream. The main distributing portion 41 extends in a second direction, in which the four intake passages 20 are aligned. An exhaust gas inlet portion 45 is arranged in the longitudinal middle of the main distributing portion 41. An exhaust gas backflow line 90 is branched from the exhaust passage of the engine and connected to the exhaust gas inlet portion 45. The second direction in which the intake passages 20 are aligned coincides with the first direction in which the cylinders are aligned.

One of the opposite ends of the main distributing portion 41 communicates with a first inter-cylinder distributing portion 42A, and the other end communicates with a second inter-cylinder distributing portion 42B. The first inter-cylinder distributing portion 42A configures an exhaust gas distributing portion that distributes exhaust gas to multiple passages after the exhaust gas is supplied to the exhaust gas recirculating apparatus 40. The second inter-cylinder distributing portion 42B configures another exhaust gas distributing portion that is separate from the first inter-cylinder distributing portion 42A. The first inter-cylinder distributing portion 42A is the most downstream section of the exhaust gas distributing portion in the exhaust gas recirculating apparatus 40 and extends in the second direction. The first inter-cylinder distributing portion 42A is arranged on the upper surfaces of the corresponding curved sections of the first intake passage 20A and the second intake passage 20B. The second inter-cylinder distributing portion 42B is also the most downstream section of the exhaust gas distributing portion in the exhaust gas recirculating apparatus 40 and extends in the second direction. The second inter-cylinder distributing portion 42B is arranged on the upper surfaces of the corresponding curved sections of the third intake passage 20C and the fourth intake passage 20D. The first and second inter-cylinder distributing portions 42A, 42B are arranged on a common line extending in the second direction. The length in the second direction and volume of the first inter-cylinder distributing portion 42A are substantially equal to the length in the second direction and volume of the second inter-cylinder distributing portion 42B.

A first introduction passage 43A is arranged in an end section of the first inter-cylinder distributing portion 42A in the vicinity of the first intake passage 20A. The first introduction passage 43A communicates with the first inter-cylinder distributing portion 42A and the first intake passage 20A. A second introduction passage 43B is arranged in an end section of the first inter-cylinder distributing portion 42A in the vicinity of the second intake passage 20B. The second introduction passage 43B communicates with the first inter-cylinder distributing portion 42A and the second intake passage 20B.

A third introduction passage 43C is arranged in an end section of the second inter-cylinder distributing portion 42B in the vicinity of the third intake passage 20C. The third introduction passage 43C communicates with the second inter-cylinder distributing portion 42B and the third intake passage 20C. A fourth introduction passage 43D is arranged in an end section of the second inter-cylinder distributing portion 42B in the vicinity of the fourth intake passage 20D. The fourth introduction passage 43D communicates with the second inter-cylinder distributing portion 42B and the fourth intake passage 20D.

As shown in FIG. 2, a projecting portion 21 projects from the inner wall of the second intake passage 20B. A second introduction passage 43B is formed in the projecting portion 21. Projecting portions 21 also project from the inner walls of the first intake passage 20A, the third intake passage 20C, and the fourth intake passage 20D. Like the second introduction passage 43B, a first introduction passage 43A, a third introduction passage 43C, and a fourth introduction passage 43D are formed in the projecting portion 21 of the first intake passage 20A, the third intake passage 20C, and the fourth intake passage 20D.

As illustrated in FIG. 3, exhaust gas E flows from the exhaust gas inlet portion 45 into the main distributing portion 41 and is supplied to the first inter-cylinder distributing portion 42A and the second inter-cylinder distributing portion 42B.

The exhaust gas E supplied to the first inter-cylinder distributing portion 42A is introduced into the first intake passage 20A via the first introduction passage 43A and then into the first cylinder. The exhaust gas E supplied to the first inter-cylinder distributing portion 42A is also introduced into the second intake passage 20B via the second introduction passage 43B and then into the second cylinder.

The exhaust gas E supplied to the second inter-cylinder distributing portion 42B is introduced into the third intake passage 20C via the third introduction passage 43C and then into the third cylinder. The exhaust gas E supplied to the second inter-cylinder distributing portion 42B is also introduced into the fourth intake passage 20D via the fourth introduction passage 43D and then into the fourth cylinder.

The locations in the second direction of the first introduction passage 43A and the second introduction passage 43B in the first inter-cylinder distributing portion 42A and the locations in the second direction of the third introduction passage 43C and the fourth introduction passage 43D in the second inter-cylinder distributing portion 42B are determined in the manners described below.

Figure 4:
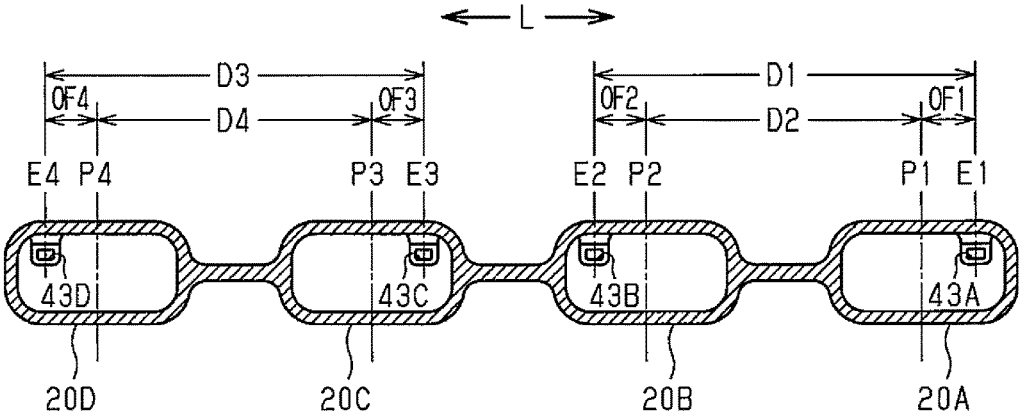
FIG. 4 is a cross-sectional view taken along line 4-4 of FIG. 2, showing intake passages.

With reference to FIG. 4, the first introduction passage 43A is arranged at such a position that the center line E1 of the first introduction passage 43A in the second direction is offset from the center line P1 of the first intake passage 20A in the second direction to be away from the second intake passage 20B. The second introduction passage 43B is arranged at such a position that the center line E2 of the second introduction passage 43B in the second direction is offset from the center line P2 of the second intake passage 20B in the second direction to be away from the first intake passage 20A.

In this manner, the first introduction passage 43A and the second introduction passage 43B are arranged such that the distance D1 between the center line E1 of the first introduction passage 43A and the center line E2 of the second introduction passage 43B is greater than the distance D2 between the center line P1 of the first intake passage 20A and the center line P2 of the second intake passage 20B. In this case, the first introduction passage 43A and the second introduction passage 43B are located maximally close to the inner walls of the intake passages. This maximally increases the offset amount of the first introduction passage 43A and the offset amount of the second introduction passage 43B.

Similarly, the third introduction passage 43C is arranged at such a position that the center line E3 of the third introduction passage 43C in the second direction is offset from the center line P3 of the third intake passage 20C in the second direction to be away from the fourth intake passage 20D. The fourth introduction passage 43D is arranged at such a position that the center line E4 of the fourth introduction passage 43D in the second direction is offset from the center line P4 of the fourth intake passage 20D in the second direction to be away from the third intake passage 20C.

In this manner, the third introduction passage 43C and the fourth introduction passage 43D are arranged such that the distance D3 between the center line E3 of the third introduction passage 43C and the center line E4 of the fourth introduction passage 43D is greater than the distance D4 between the center line P3 of the third intake passage 20C and the center line P4 of the fourth intake passage 20D. Also in this case, the third introduction passage 43C and the fourth introduction passage 43D are located maximally close to the inner walls of the intake passages. This maximally increases the offset amount of the third introduction passage 43C and the offset amount of the fourth introduction passage 43D.

The distance D1 is equal to the distance D3 but may be unequal to the distance D3. Also, the distance D2 is equal to the distance D4 but may be unequal to the distance D4.

The above-described embodiment achieves the following advantages.

(1) The first introduction passage 43A and the second introduction passage 43B are each arranged such that the distance D1 between the center line E1 of the first introduction passage 43A and the center line E2 of the second introduction passage 43B is greater than the distance D2 between the center line P1 of the first intake passage 20A and the center line P2 of the second intake passage 20B.

This increases the distance between the first introduction passage 43A and the second introduction passage 43B, which are connected to the first inter-cylinder distributing portion 42A, to separate the first introduction passage 43A from the second introduction passage 43B, as compared with a case in which the first introduction passage 43A and the second introduction passage 43B are arranged such that the distance D1 is not greater than the distance D2. As a result, even if fresh air flows into either one of the first and second introduction passages 43A, 43B after blowing back from the corresponding intake passage, the fresh air is unlikely to flow into the other one of the introduction passages 43A, 43B. For example, when fresh air blows back from the first intake passage 20A and flows into the first introduction passage 43A, the fresh air is unlikely to flow into the second introduction passage 43B, which is the other introduction passage. This limits decrease of the introduction amount of exhaust gas caused by the fresh air, which has blown back and flows into the other introduction passage, in the intake passage communicating with this introduction passage. As a result, between the first cylinder and the second cylinder into which the exhaust gas supplied to the first inter-cylinder distributing portion 42A is introduced, variation in the amount of exhaust gas introduced into these cylinders is reduced.

(2) The first introduction passage 43A is arranged at such a position that the center line E1 of the first introduction passage 43A is offset from the center line P1 of the first intake passage 20A to be away from the second intake passage 20B. The second introduction passage 43B is arranged at such a position that the center line E2 of the second introduction passage 43B is offset from the center line P2 of the second intake passage 20B to be away from the first intake passage 20A.

With reference to FIG. 4, the amount by which the center line E1 of the first introduction passage 43A is offset from the center line P1 of the first intake passage 20A to be away from the second intake passage 20B is referred to as the offset amount OF1. The amount by which the center line E2 of the second introduction passage 43B is offset from the center line P2 of the second intake passage 20B to be away from the first intake passage 20A is referred to as the offset amount OF2. In the present embodiment, the distance D1 is greater than the distance D2 by the distance corresponding to the sum of the offset amount OF1 and the offset amount OF2.

(3) The third introduction passage 43C and the fourth introduction passage 43D are each arranged such that the distance D3 between the center line E3 of the third introduction passage 43C and the center line E4 of the fourth introduction passage 43D is greater than the distance D4 between the center line P3 of the third intake passage 20C and the center line P4 of the fourth intake passage 20D.

This increases the distance between the third introduction passage 43C and the fourth introduction passage 43D, which are connected to the second inter-cylinder distributing portion 42B, to separate the third introduction passage 43C from the fourth introduction passage 43D, as compared with a case in which the third introduction passage 43C and the fourth introduction passage 43D are arranged such that the distance D3 is not greater than the distance D4. As a result, even if fresh air flows into either one of the third and fourth introduction passages 43C, 43D after blowing back from the corresponding intake passage, the fresh air is unlikely to flow into the other one of the introduction passages 43C, 43D. For example, when fresh air blows back from the fourth intake passage 20D and flows into the fourth introduction passage 43D, the fresh air is unlikely to flow into the third introduction passage 43C, which is the other introduction passage. This limits decrease of the introduction amount of exhaust gas caused by the fresh air, which has blown back and flows into the other introduction passage, in the intake passage communicating with this introduction passage. As a result, between the third cylinder and the fourth cylinder into which the exhaust gas supplied to the second inter-cylinder distributing portion 42B is introduced, variation in the amount of exhaust gas introduced into these cylinders is reduced.

(4) The third introduction passage 43C is arranged at such a position that the center line E3 of the third introduction passage 43C is offset from the center line P3 of the third intake passage 20C to be away from the fourth intake passage 20D. The fourth introduction passage 43D is arranged at such a position that the center line E4 of the fourth introduction passage 43D is offset from the center line P4 of the fourth intake passage 20D to be away from the third intake passage 20C.

Referring to FIG. 4, the amount by which the center line E3 of the third introduction passage 43C is offset from the center line P3 of the third intake passage 20C to be away from the fourth intake passage 20D is referred to as the offset amount OF3. The amount by which the center line E4 of the fourth introduction passage 43D is offset from the center line P4 of the fourth intake passage 20D to be away from the third intake passage 20C is referred to as the offset amount OF4. In the present embodiment, the distance D3 is greater than the distance D4 by the distance corresponding to the sum of the offset amount OF3 and the offset amount OF4.

(5) The exhaust gas recirculating apparatus 40 is integrated with the intake manifold 10. This decreases the number of components as compared with a case in which the exhaust gas recirculating apparatus 40 is separate from the intake manifold 10 and is joined to the intake manifold 10.

The above-described embodiment may be modified as follows.

Figure 5:
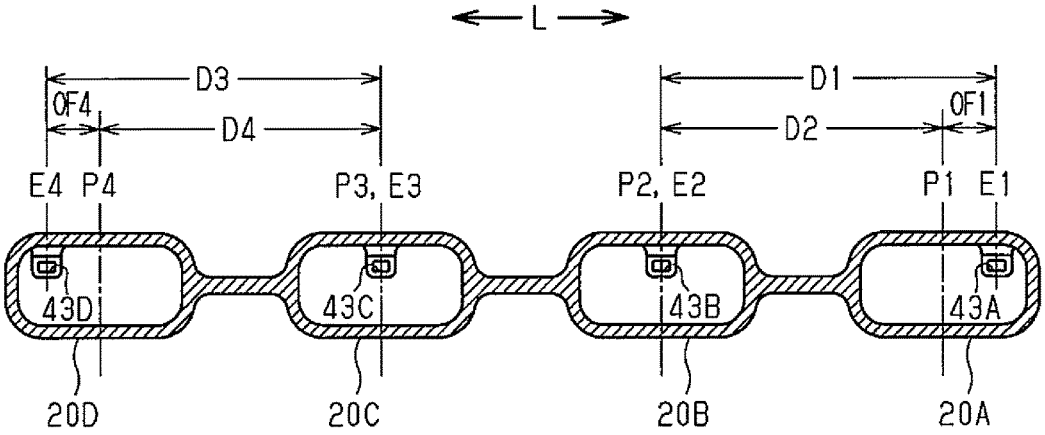
FIG. 5 is a cross-sectional view showing intake passages of a modification.
Figure 6:
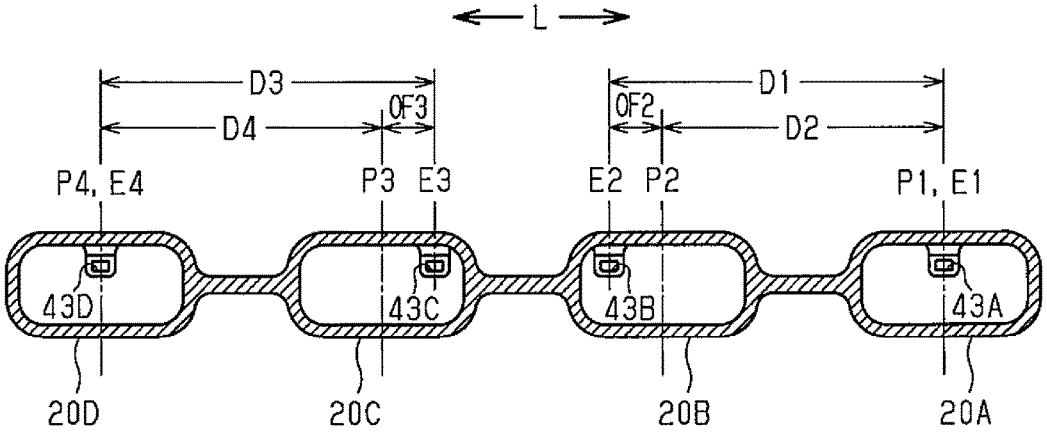
FIG. 6 is a cross-sectional view showing intake passages of another modification.

To set the distance D1 between the center line E1 of the first introduction passage 43A and the center line E2 of the second introduction passage 43B greater than the distance D2 between the center line P1 of the first intake passage 20A and the center line P2 of the second intake passage 20B, the first introduction passage 43A and the second introduction passage 43B are arranged offset from the center line P1 of the first intake passage 20A and the center line P2 of the second intake passage 20B, respectively. However, the distance D1 may be set greater than the distance D2 in any other suitable manner. FIGS. 5 and 6 show examples of such modifications.

With reference to FIG. 5, the first introduction passage 43A may be arranged at such a position that the center line E1 of the first introduction passage 43A is offset from the center line P1 of the first intake passage 20A to be away from the second intake passage 20B. On the other hand, the second introduction passage 43B may be arranged at such a position that the center line E2 of the second introduction passage 43B coincides with the center line P2 of the second intake passage 20B.

Referring to FIG. 6, the second introduction passage 43B may be arranged at such a position that the center line E2 of the second introduction passage 43B is offset from the center line P2 of the second intake passage 20B to be away from the first intake passage 20A. On the other hand, the first introduction passage 43A may be arranged at such a position that the center line E1 of the first introduction passage 43A coincides with the center line P1 of the first intake passage 20A.

Also in these modifications, the distance D1 is greater than the distance D2. This ensures the advantage described in the item (1).

Further, to set the distance D3 between the center line E3 of the third introduction passage 43C and the center line E4 of the fourth introduction passage 43D greater than the distance D4 between the center line P3 of the third intake passage 20C and the center line P4 of the fourth intake passage 20D, the third introduction passage 43C and the fourth introduction passage 43D are arranged offset from the center line P3 of the third intake passage 20C and the center line P4 of the fourth intake passage 20D, respectively. However, the distance D3 may be set greater than the distance D4 in any other suitable manner. FIGS. 5 and 6 show examples of such modifications.

As illustrated in FIG. 5, the fourth introduction passage 43D may be arranged at such a position that the center line E4 of the fourth introduction passage 43D is offset from the center line P4 of the fourth intake passage 20D to be away from the third intake passage 20C. On the other hand, the third introduction passage 43C may be arranged at such a position that the center line E3 of the third introduction passage 43C coincides with the center line P3 of the third intake passage 20C.

Referring to FIG. 6, the third introduction passage 43C may be arranged at such a position that the center line E3 of the third introduction passage 43C is offset from the center line P3 of the third intake passage 20C to be away from the fourth intake passage 20D. On the other hand, the fourth introduction passage 43D may be arranged at such a position that the center line E4 of the fourth introduction passage 43D coincides with the center line P4 of the fourth intake passage 20D.

Also in these modifications, the distance D3 is greater than the distance D4. This ensures the advantage described in the item (3).

Figure 7:
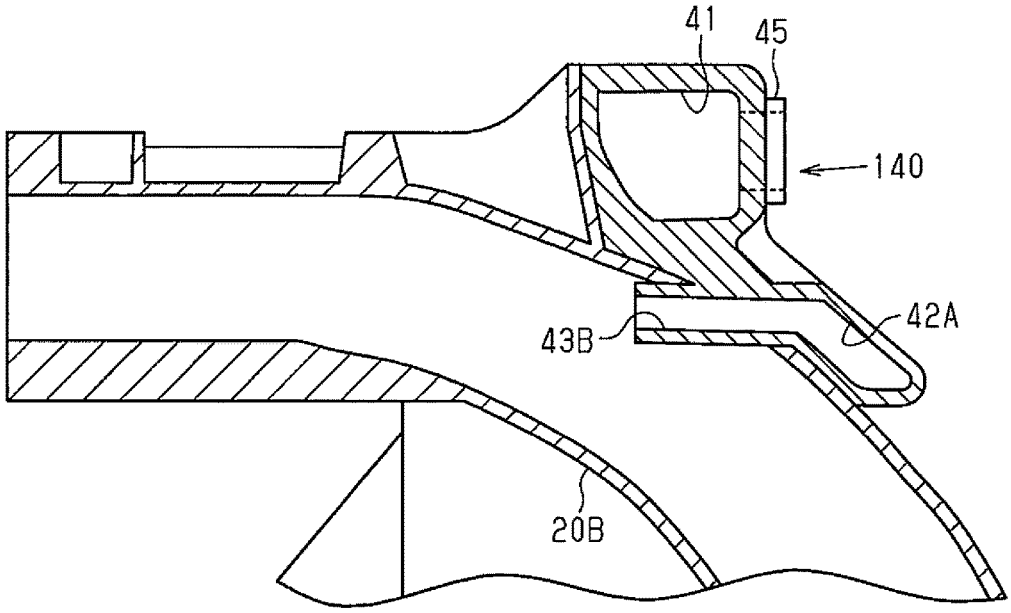
FIG. 7 is a cross-sectional view showing an intake manifold of another modification.

As illustrated in FIG. 7, an exhaust gas recirculating apparatus 140, which is formed separately from the intake manifold 10, may be joined to the intake manifold 10. The exhaust gas recirculating apparatus 140 has a main distributing portion 41, which has an exhaust gas inlet portion 45, a first inter-cylinder distributing portion 42A, a second inter-cylinder distributing portion 42B, a first introduction passage 43A, a second introduction passage 43B, a third introduction passage 43C, and a fourth introduction passage 43D.

In the above-described embodiment, three or more introduction passages may be arranged in a single inter-cylinder distributing portion. In this case, any two of the three or more introduction passages are referred to as the first introduction passage 43A and the second introduction passage 43B. The first introduction passage 43A and the second introduction passage 43B are arranged such that the distance D1 is greater than the distance D2. This configuration ensures the same advantages as those of the embodiment.

The exhaust gas recirculating apparatus 40 may be employed as an exhaust gas recirculating apparatus for an internal combustion engine that is not a four-cylinder engine. For example, the exhaust gas recirculating apparatus 40 may lack the main distributing portion 41, the second inter-cylinder distributing portion 42B, the third introduction passage 43C, and the fourth introduction passage 43D and have the exhaust gas inlet portion 45 in the first inter-cylinder distributing portion 42A. This allows the exhaust gas recirculating apparatus 40 to be employed in a two-cylinder engine. That is, the exhaust gas recirculating apparatus is only required to have introduction passages via which exhaust gas is introduced into intake passages that are connected to corresponding cylinders and to connect those of the introduction passages arranged in two or more of the intake passages to a single inter-cylinder distributing portion. In other words, by modifying the exhaust gas recirculating apparatus 40 as needed in correspondence with the number of the cylinders, the exhaust gas recirculating apparatus 40 may be employed as an exhaust gas recirculating apparatus for a two-cylinder, six-cylinder, or eight-cylinder internal combustion engine other than a four-cylinder engine.

The invention claimed is:

1. An exhaust gas recirculating apparatus arranged in an intake manifold that has a plurality of intake passages, wherein the intake passages are aligned in a first direction, in which cylinders of an internal combustion engine are aligned, and connected to the cylinders, and the exhaust gas recirculating apparatus includes an exhaust gas distributing portion that distributes exhaust gas supplied to the exhaust gas recirculating apparatus to a plurality of passages, and the exhaust gas recirculating apparatus being configured to introduce the exhaust gas into the respective intake passages, the exhaust gas recirculating apparatus comprising:

an inter-cylinder distributing portion, which is a most downstream section of the exhaust gas distributing portion and extends in a second direction, in which the intake passages are aligned;

a first introduction passage, which allows communication between a first intake passage, which is one of adjacent two of the intake passages, and the inter-cylinder distributing portion; and a second introduction passage, which allows communication between a second intake passage, which is the other one of the adjacent two intake passages, and the inter-cylinder distributing portion, with which the first introduction passage communicates, wherein the first introduction passage and the second introduction passage are each arranged such that a distance between a center line of the first introduction passage in the second direction and a center line of the second introduction passage in the second direction is greater than a distance between a center line of the first intake passage in the second direction and a center line of the second intake passage in the second direction.

2. The exhaust gas recirculating apparatus according to claim 1, wherein the first introduction passage is arranged at such a position that the center line of the first introduction passage in the second direction is offset from the center line of the first intake passage in the second direction to be away from the second intake passage, and the second introduction passage is arranged at such a position that the center line of the second introduction passage in the second direction is offset from the center line of the second intake passage in the second direction to be away from the first intake passage.

3. The exhaust gas recirculating apparatus according to claim 2, wherein the engine is a four-cylinder internal combustion engine, the cylinders are a first cylinder, a second cylinder, a third cylinder, and a fourth cylinder arranged sequentially in the first direction, the inter-cylinder distributing portion is a first inter-cylinder distributing portion, the intake passage connected to the first cylinder is the first intake passage, the intake passage connected to the second cylinder is the second intake passage, the intake passage connected to the third cylinder is a third intake passage, the intake passage connected to the fourth cylinder is a fourth intake passage, the exhaust gas recirculating apparatus further comprises:

a second inter-cylinder distributing portion, which is a most downstream section of the exhaust gas distributing portion and extends in the second direction;

a third introduction passage, which communicates with the second inter-cylinder distributing portion and the third intake passage; and a fourth introduction passage, which communicates with the second inter-cylinder distributing portion, with which the third introduction passage communicates, and the fourth intake passage, the third introduction passage is arranged at such a position that the center line of the third introduction passage in the second direction is offset from the center line of the third intake passage in the second direction to be away from the fourth intake passage, and the fourth introduction passage is arranged at such a position that the center line of the fourth introduction passage in the second direction is offset from the center line of the fourth intake passage in the second direction to be away from the third intake passage.

4. The exhaust gas recirculating apparatus according to claim 1, wherein the exhaust gas recirculating apparatus is integrated with the intake manifold.

* * * * *